US005088739A

United States Patent [19]

Mitchell

[11] Patent Number: 5,088,739

[45] Date of Patent: Feb. 18, 1992

[54] GAME HAVING AN ENVIRONMENTAL THEME

[75] Inventor: Lu-Anne Mitchell, Hillsborough, Calif.

[73] Assignee: Chez L.A. Salon Ltd., Saskatoon, Canada

[21] Appl. No.: 577,537

[22] Filed: Sep. 5, 1990

Related U.S. Application Data

[63] Continuation-in-part of Ser. No. 528,538, May 5, 1990.

[51] Int. Cl.[5] ..... A63F 3/00; A63F 9/18; A63F 9/00

[52] U.S. Cl. ..... 273/248; 273/142 J; 273/138 R; 273/148 R; 273/273; 273/DIG. 26

[58] Field of Search ..... 273/273, 249, 243, 256, 273/148 R, 142 J, 138 R, DIG. 26

[56] References Cited

U.S. PATENT DOCUMENTS

| | | | |
|---|---|---|---|
| 3,740,038 | 6/1973 | Feulner | 273/243 |
| 4,090,717 | 5/1978 | Rossetti | 273/249 |
| 4,214,755 | 7/1980 | Wysocki | 273/243 |
| 4,635,939 | 1/1987 | Makow | 273/296 |
| 4,714,255 | 12/1987 | Henry et al. | 273/249 |
| 4,807,878 | 2/1989 | Tripp | 273/1 E |
| 4,815,976 | 3/1989 | Krane | 273/243 |
| 4,944,519 | 7/1990 | Canela | 273/243 |

FOREIGN PATENT DOCUMENTS

| | | | |
|---|---|---|---|
| 7322 | 2/1980 | European Pat. Off. | 273/256 |
| 2200291 | 3/1988 | United Kingdom | 273/249 |

*Primary Examiner*—Benjamin Layno
*Attorney, Agent, or Firm*—H. Jay Spiegel

[57] ABSTRACT

The present invention relates to an improved game having an environmental theme. In the improved game, players work together to solve environmental crises within a specified number of turns. In a first embodiment, an inventive board game is disclosed wherein players travel along World Boards until the environmental crises are solved. Once the environmental crises are solved, the players may travel along an additional passageway on the World Boards and win the game. In a second embodiment, the inventive game is adapted for a television game show in which players compete to solve environmental crises. In the television game show, players are assigned particular environmental crises and, using a chance device, attempt to obtain the corresponding environmental solution to end the game.

15 Claims, 10 Drawing Sheets

FIG. 3A
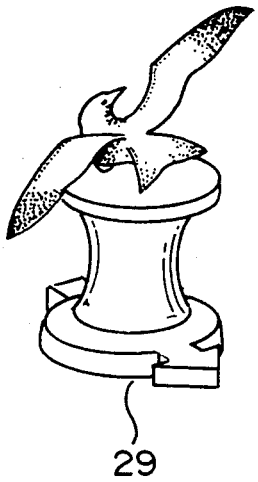
FIG. 3B
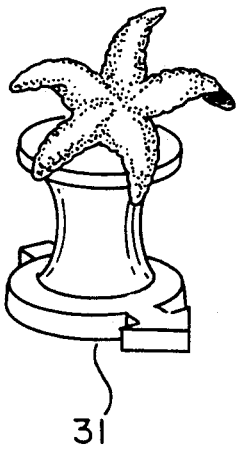
FIG. 3C
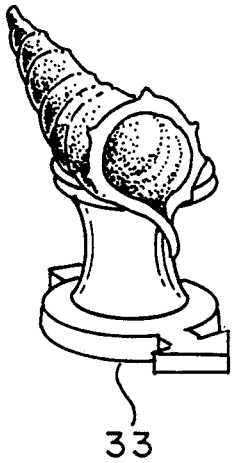
FIG. 3D
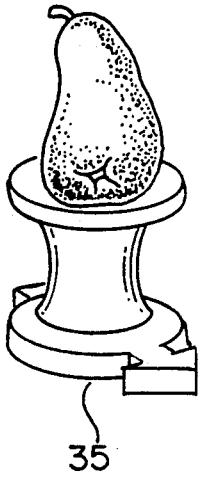
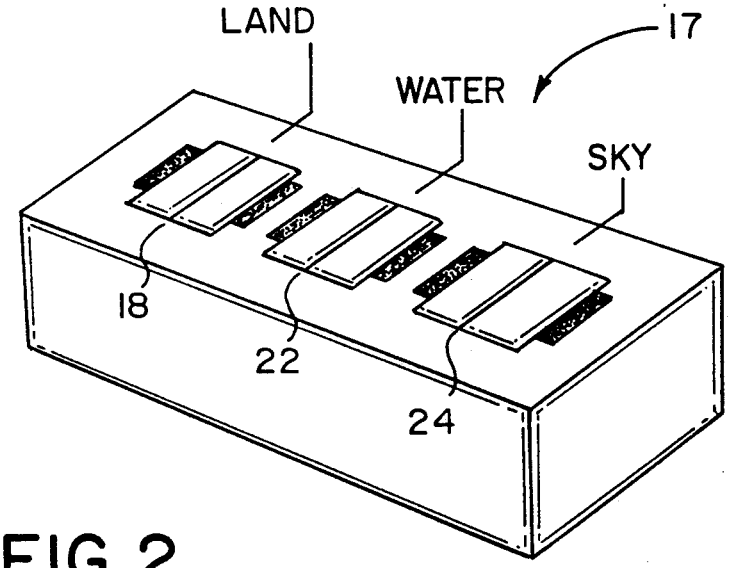
FIG. 2

SKY
1 START
2
3 G.S.
4
5 M.E.
6
7 G.S.
8 PLUTO
9
10
11 M.E.
12
13
14 G.S.
15
16 M.E.
17
18
19 G.S.
20
21 G.S.
22
23
24 M.E.
25
26 G.S.
27
28 M.E.
29
30
31
32 LAUNCH
71
73
61

WATER
1 START
2
3
4
5
6 G.S.
7
8
9 M.E.
10
11
12
13 M.E.
14
15 G.S.
16
17 G.S.
18
19 M.E.
20
21
22 G.S.
23
24 SEVERN RIVER ENGLAND
25 G.S.
26
27 M.E.
28
29
30 G.S.
31
32 LAUNCH
71
73
65

LAND
1 START
2
3
4 G.S.
5
6 M.E.
7
8 G.S.
9
10 M.E.
11
12 G.S.
13
14 U.KINGDOM
15 ISRAEL
16 G.S.
17
18 M.E.
19 FINLAND
20 G.S.
21
22
23 M.E.
24
25
26
27 G.S.
28
29 G.S.
30
31 M.E.
32 LAUNCH
75
76
57
63
55
59
61
72

GAME HAVING AN ENVIRONMENTAL THEME

This application is a continuation-in-part of the parent application Ser. No. 07/528,538 filed May 5, 1990 still pending.

BACKGROUND OF THE INVENTION

The present invention relates to an improved game having an environmental theme. In the prior art, board games whose purpose is to solve world problems are known. U.S. Pat. No. 3,740,038 to Feulner and U.S. Pat. No. 4,733,869 to Dapper, et al., disclose these types of board games. However, Applicant is unaware of any game, either a board game or a game adapted for television, which includes all of the features of the present invention, including as a theme solving environmental crises.

SUMMARY OF THE INVENTION

The present invention relates to a game having an environmental theme. In a first embodiment, the inventive game includes a board game wherein players work together to solve environmental crises or problems. In a second embodiment, the inventive game may be adapted for television, wherein a similar theme of solving environmental crises or problems is used. The present invention includes the following interrelated aspects and features:

(A) In a first embodiment, the inventive board game is played on four generally pie-shaped boards. Each board represents an area of the world and includes four passageways thereon. Three passageways are travelled upon by players, with the fourth passageway being travelled upon only upon completion of certain game requirements which will be described hereinafter. Each of the three passageways includes thirty-two spaces, with the fourth passageway including seven spaces. The fourth passageway leads to the innermost section of each board, whereby reaching this innermost section results in winning of the game.

(B) The spaces on each of the first three passageways of each world board include twenty spaces designating geographic areas pertaining to the theme of each world board, and twelve instructional spaces. The seven spaces in the fourth passageway are depicted as unattractive blotches of pollution, these spaces to be covered up by an environmental solution card when a particular environmental problem has been solved.

(C) The game equipment further includes a central circular shaped board made up of four equal sections, the circularly shaped board providing an area for holding the instruction cards during play. Furthermore, a container is included which acts as a receptacle to hold the Ecolottery tickets during playing of the game. Each of the four sections of the central circular shaped board includes a counting device associated therewith, each counting device to be used by a player during playing of the game. Furthermore, three globes are provided: a land globe, a water globe, and a sky or air globe. The globe that is in play is mounted in a globe holder which permits the globe to be spun on its axis, the globe holder located centrally in the central circular shaped board. The globe holder has attached thereto a pointer device, the pointer device being configured in a 180° arc. The pointer device also includes seven colored points thereon which are used to indicate a particular location on a globe when in play.

(D) Also provided are globe cups for holding the globes not in play, tokens to be moved along the playing boards, four sets of instructional cards, i.e., Mother Earth Solution Cards, Grandfather Sun cards, Grandmother Moon cards, Crisis cards, and a plurality of lottery tickets with a receptacle for holding the lottery tickets so that they may be drawn during playing of the game. Finally, a game currency is provided, Ecounits, which permits transactions of monetary value to occur during the game.

(E) The object of the game is to solve all of the crises or problems specified on the Crisis Cards by using the Solution Cards before a specified number of turns have been played. Solving the crises or problems permits the fourth passageway to be travelled upon and permits the players to reach the innermost section of each game board. Players must work with all of the other players to solve the crisis problems presented by the Crisis or problems Cards. If all crises are not solved before the specified number of turns, the game is over.

(F) In a second embodiment, the inventive game may be adapted for a television game show, wherein a plurality of players act together to solve environmental crises in the world. In the television game show embodiment, an electronic globe is provided in place of the world boards and globes for the board game as described above which delineates the different geographical areas of the world, divided between land, water and sky. Furthermore, each player is provided with a station which includes a display for tracking the players' Ecounits and permitting the players to spin a wheel that is adjacent the station.

(G) Behind the players, stations is a first display board that illustrates the particular crises that each player must solve. A second display board adjacent the first display board includes the three categories of water, sky and land, each category having a corresponding color associated therewith. The top portion of the second display board shows the particular crises or problems which have been selected by random by each player, with the lower portion of the second display showing the corresponding solutions to the crises or problems. Players select a color and, by random means, a given crisis or problems is displayed on the first board. That player then has to solve that crisis or problems by playing of the game. The solutions to the crisis or problem selected, are displayed on the lower portion of the second display board and are selected through spinning of the wheel by the players.

(H) The spinning wheel includes a plurality of spaces thereon which direct play of the game. The spinning wheel includes the instruction cards as described above for the inventive board game as well as color-coded Mother Earth spaces which correspond to the different solutions for each crisis.

Accordingly, it is a first object of the present invention to provide an improved game having an environmental crisis or problem solving theme.

It is a further object of the present invention to provide an improved board game wherein all players collaborate together to solve world problems and crises or problem in a specified number of turns.

It is a yet further object of the present invention to provide a game having an environmental crisis or problem solving theme being adapted for a television game show.

It is still a further object of the present invention to provide an educational game which provides the players with knowledge concerning worldwide ecology, situations threatening the ecology, and potential solutions for solving ecological crises or problems.

These and other objects, aspects and features of the present invention will be better understood from the following detailed description of the preferred embodiments when read in conjunction with the appended drawing figures.

BRIEF DESCRIPTION OF THE DRAWINGS

FIG. 2 shows a counting device for use in the board game.

FIG. 3 shows an exemplary set of tokens for use in playing the inventive board game.

FIGS. *7a* and *7b* show a prospective view of a portion of the television game show layout.

Figure 8:
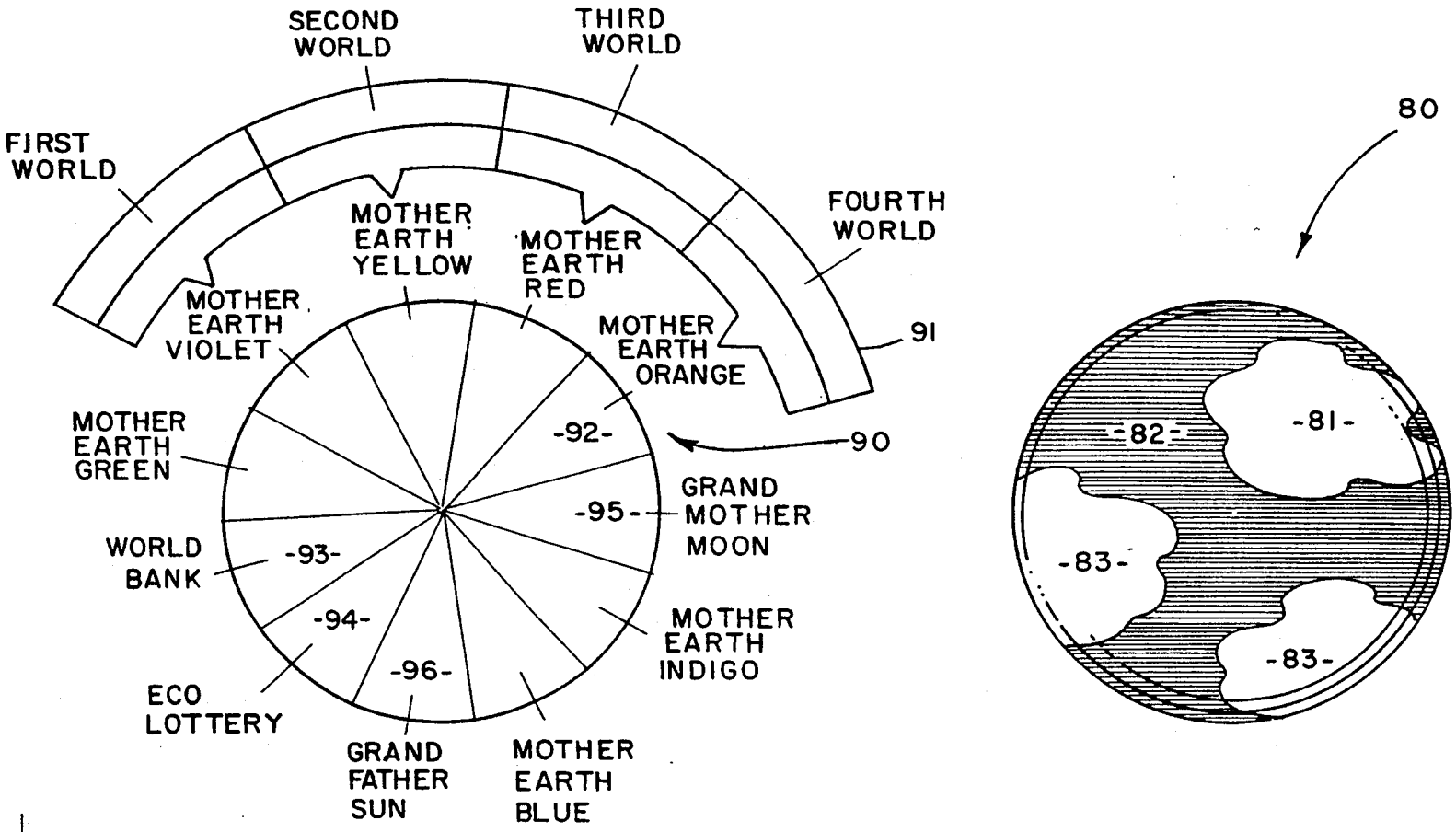

FIG. 8 shows the spinning wheel and electronic globe associated with the television game show.

Figure 9:
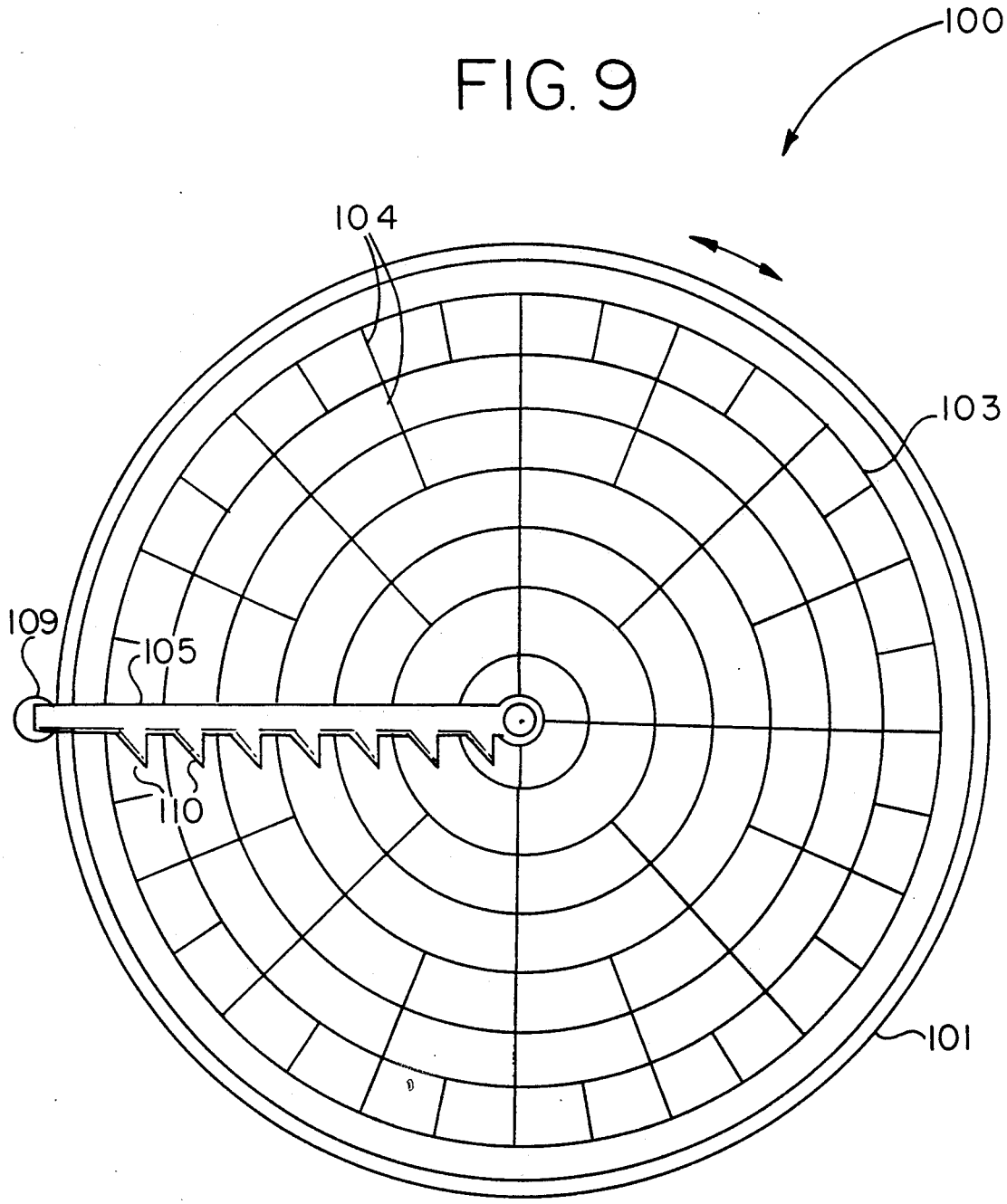

FIG. 9 shows a top view of a rotating disc assembly as an alternative to the globe spinning device.

Figure 10:
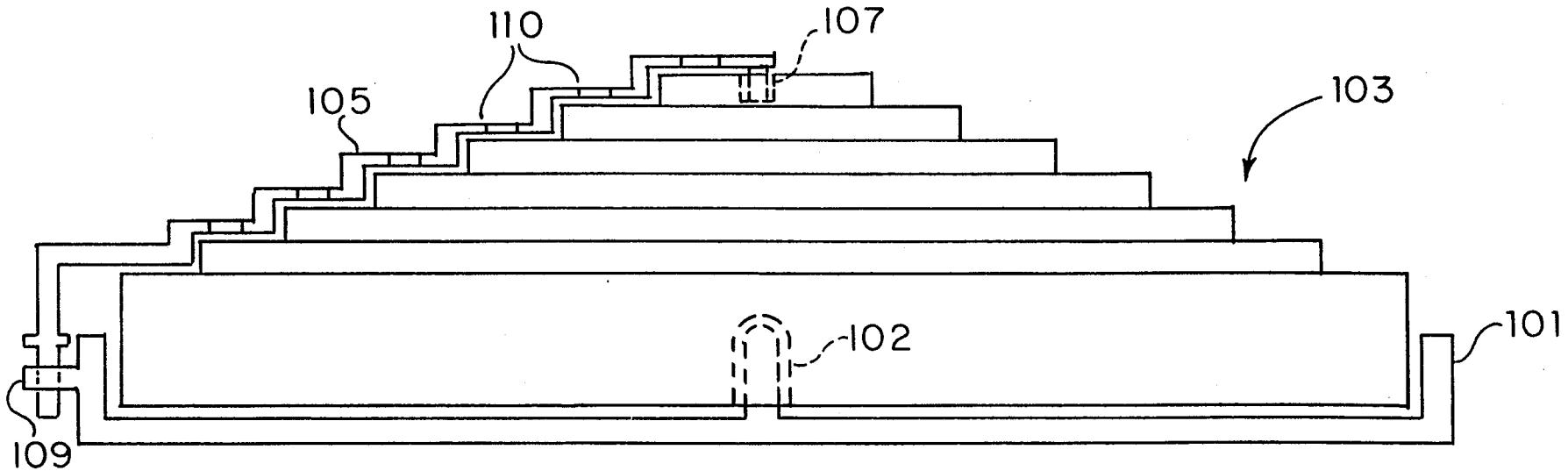

FIG. 10 shows a side view of the assembly shown in FIG. 9.

SPECIFIC DESCRIPTION OF THE

Figure 1A:
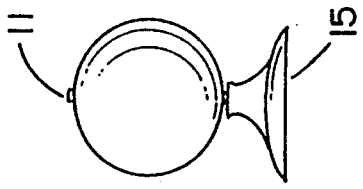
FIGS. 1A and 1B show spinning globes for use in the board game.
Figure 1B:
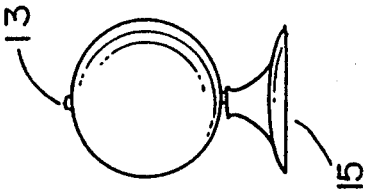
Figure 1:
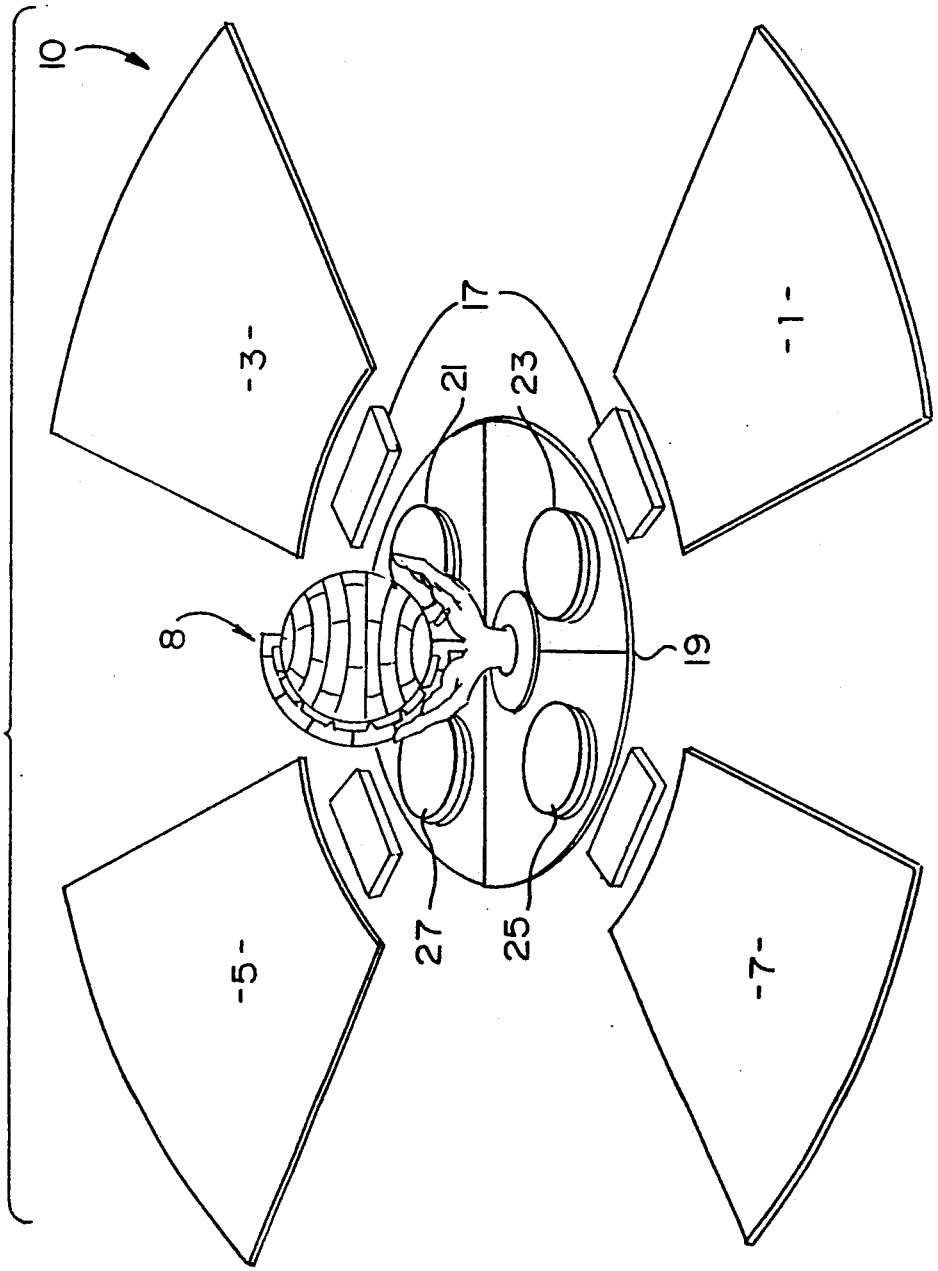
FIG. 1 shows a side perspective view of an exemplary layout of the inventive board game.

With reference to the first embodiment, the inventive game board, and to FIG. 1, a schematic representation of the board game embodiment of the environmental theme game is generally designated by the reference numeral 10 and is seen to include a plurality of world boards 1, 3, 5 and 7. The first world board 1 may represent developed nations of the Western world. The second world board 3 may represent developed nations of the Eastern world. The third and fourth world boards 5 and 7 may represent developing nations and Aboriginal or the remaining nations, respectively. The details of an exemplary world board will be described hereinafter. Also shown in FIG. 1 is a spinning globe device 8 which rests upon a central station 19. The spinning globe 8 is used during playing of the game and directs movements of the individual players.

The central station 19 also includes an area for the ecolottery draw drum and various instruction cards. The instruction cards, which will be described in greater detail hereinafter, include forty-two Mother Earth Solution Cards 23, forty-two Grandmother Moon Cards 25, which contain directions for each turn of play, and thirty-two Grandfather Sun Cards 27, which provide words of wisdom, gifts, and instructions for globe use. There are also forty-two Crisis Cards (not illustrated). Seven Crisis Cards are drawn by each player at commencement of play and placed adjacent to the outside edge of the World Board. The remainder are located out of play. With reference to FIG. 2 and FIG. 1 again, an exemplary counting device 17 is shown adjacent to each world board. The counting device 17 includes a plurality of counters thereon 18, 22 and 24 for recording the number of moves on the different passageways of the world boards for each player. These counting devices may be similar to those used in association with billiard tables, wherein a particular count is recorded by rotation of a knurled wheel adjacent a number display; or any device appropriate to the style of any version of the inventive board game.

With reference back to FIG. 1, two additional globes, 11 and 13, respectively, are shown supported on globe resting means 15. In total, there are three globes, one for land, one for water, and one for sky, each of which will be described in greater detail hereinafter.

FIG. 3 depicts four exemplary tokens, a bird 29, a starfish 31, a shell 33 and a pear 35, which may be used by the players. Each token includes a base portion having an arrow thereon for use in keeping track of direction of play. Although not depicted, other tokens may be used, for example, a panda, a kangaroo, a deer or an olive branch representing land, a whale, seaweed, or a fish representing water, and an eagle, a dove, a pelican or a seagull representing sky. Three tokens are used by each player, a token for land, water and sky, each respective token to be used in the corresponding passageway on each world board for each player.

Figure 4:
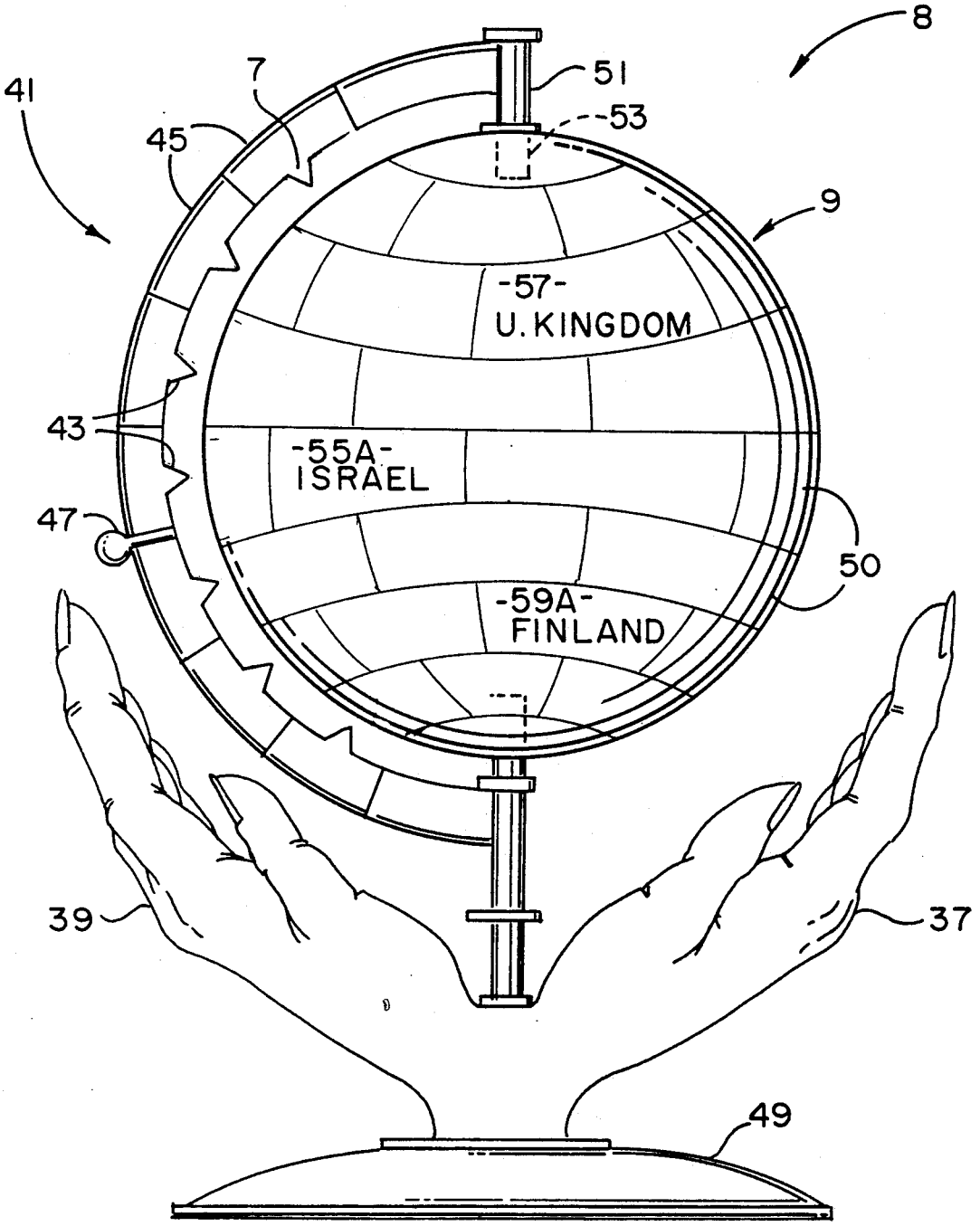
FIG. 4 shows a side view of one of the globe spinning device of the inventive board game.

FIG. 4 more clearly depicts the spinning globe device 8 and is seen to include the land globe 9 mounted on the base 49. The base 49 includes a pair of hands 37 and 39 which symbolically show the globe being cradled. The globe device 8 also includes a pointer 41 which includes a plurality of colored segments 45, each segment having an arrow pointer 43 thereon. The colored segments 45 may correspond to the rainbow colors, red, orange, yellow, green, blue, indigo and violet.

The pointer 41 may be hinged at the reference numeral 47 so that the pointer end portion 51 may be removed from the opening 53 in the land globe 9. Insertion of globes into the pointer may be alternatively accomplished by a spike and slot arrangement, with 51 being a drop-pin. The globe 9 may be removed and replaced with either a water globe 11 or a sky globe 13. As will be described later, the Grandfather Sun cards affect the changing of the globes during play.

FIG. 4 depicts an exemplary land globe 9 being segmented into a plurality of spaces 50. Each space on the land globe 9 may represent a geographic location on land which corresponds to a space on one of the land passageways on each of the world boards. Each of the globes is divided into a plurality of latitudinally arranged segments. Preferably, each globe has two segments with four spaces, two segments with eight spaces, two segments with sixteen spaces, and a middle segment with twenty-four spaces. In total, each globe has eighty spaces, all three globes having two hundred and forty spaces in total. For illustration purposes, the land globe 9 shows exemplary land locations Israel 55A, United Kingdom 57A, and Finland 59A. As will be apparent hereinafter, these geographical locations are illustrated on the land passageways of the first world board depicted in FIG. 6.

It should be understood that each globe, the land globe, the sky globe and the water globe, contain an appropriate geographic location on each space delineated on the respective globe. For example, the water globe would depict geographic locations, such as rivers and lakes, with the sky globe depicting locations located in the sky or in the air, for example, stars or the like. As will be described hereinafter during the description of how the game is played, when the globe is spun and a predetermined colored pointer rests adjacent a specific space on the globe, a player then moves his token to that corresponding space on a respective World Board.

Figure 5:
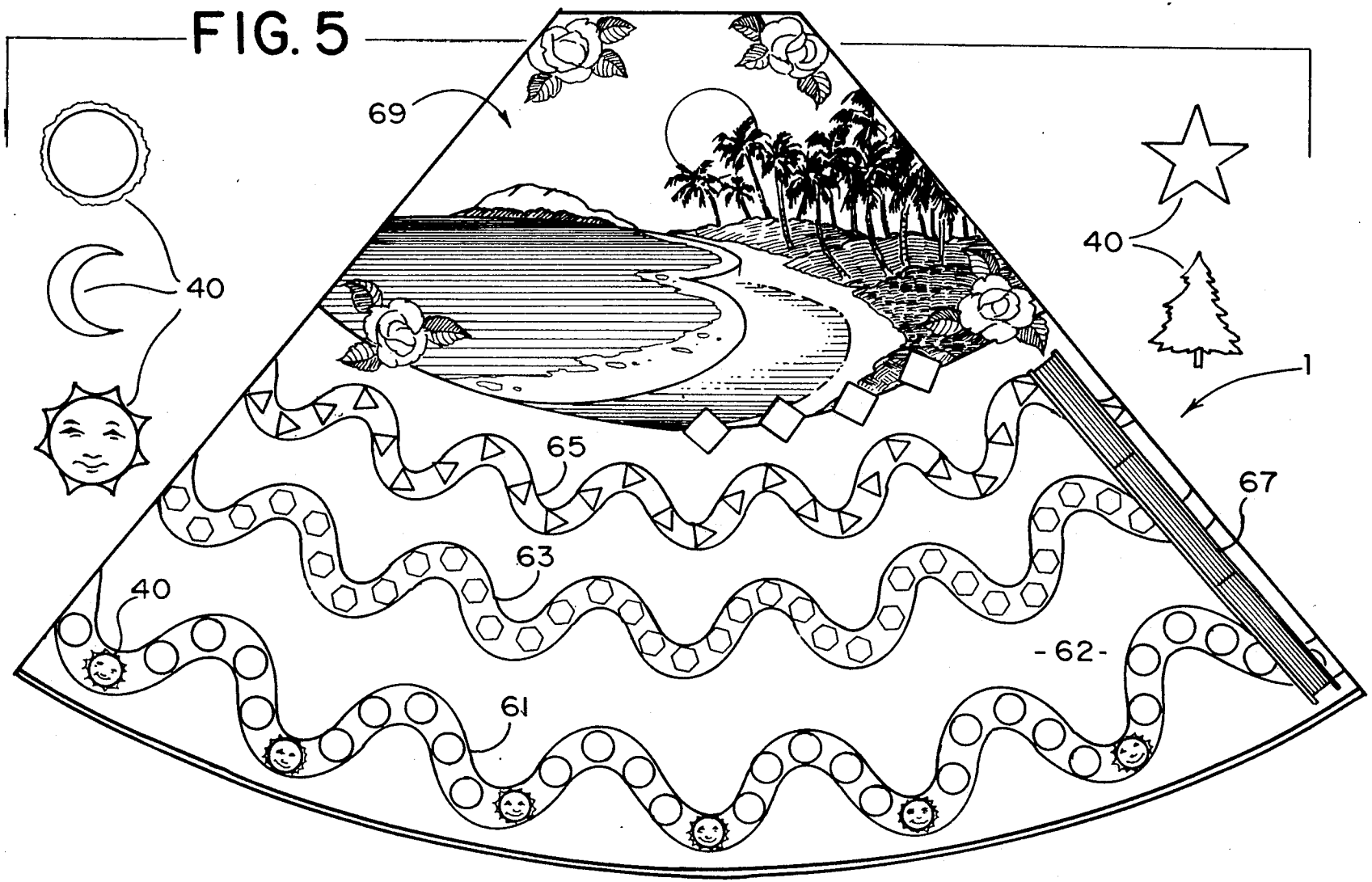
FIG. 5 shows a top view of an exemplary world board.

FIG. 5 more clearly shows an exemplary World Board 1. Each World Board is laid out in a similar fashion as the board depicted in FIG. 5. The World Board 1 includes three passageways: the land passageway 61, also called the Spiral Passage, the water passageway 63, also called the Stream of Awareness, and the sky passageway 65, also called the Milky Way. Running between the passageways are various graphics, one of which is a river 62, the Great River of Wisdom. At the end of the three passageways is a fourth passageway 67 which acts as a bridge over the river 62 and a pathway towards the central portion 69 on the World Board 1. The pathway 67, the Pathway to Paradise, consists of seven spaces of stepping stones which mark a path to central portion 69, Paradise on Earth, three spaces on the bridge and four diamond-shaped spaces adjacent the central portion 69. Reaching Paradise on Earth 69 is the goal of the game, thereby resulting in the planet Earth being saved from environmental destruction. FIG. 5 also illustrates different indicia which may be used to designate an instructional space. For example, the sun indicia 40 may be located on land passageway 61 to designate selecting a Grandfather Sun Card.

Figures 6A, 6B, 6C:
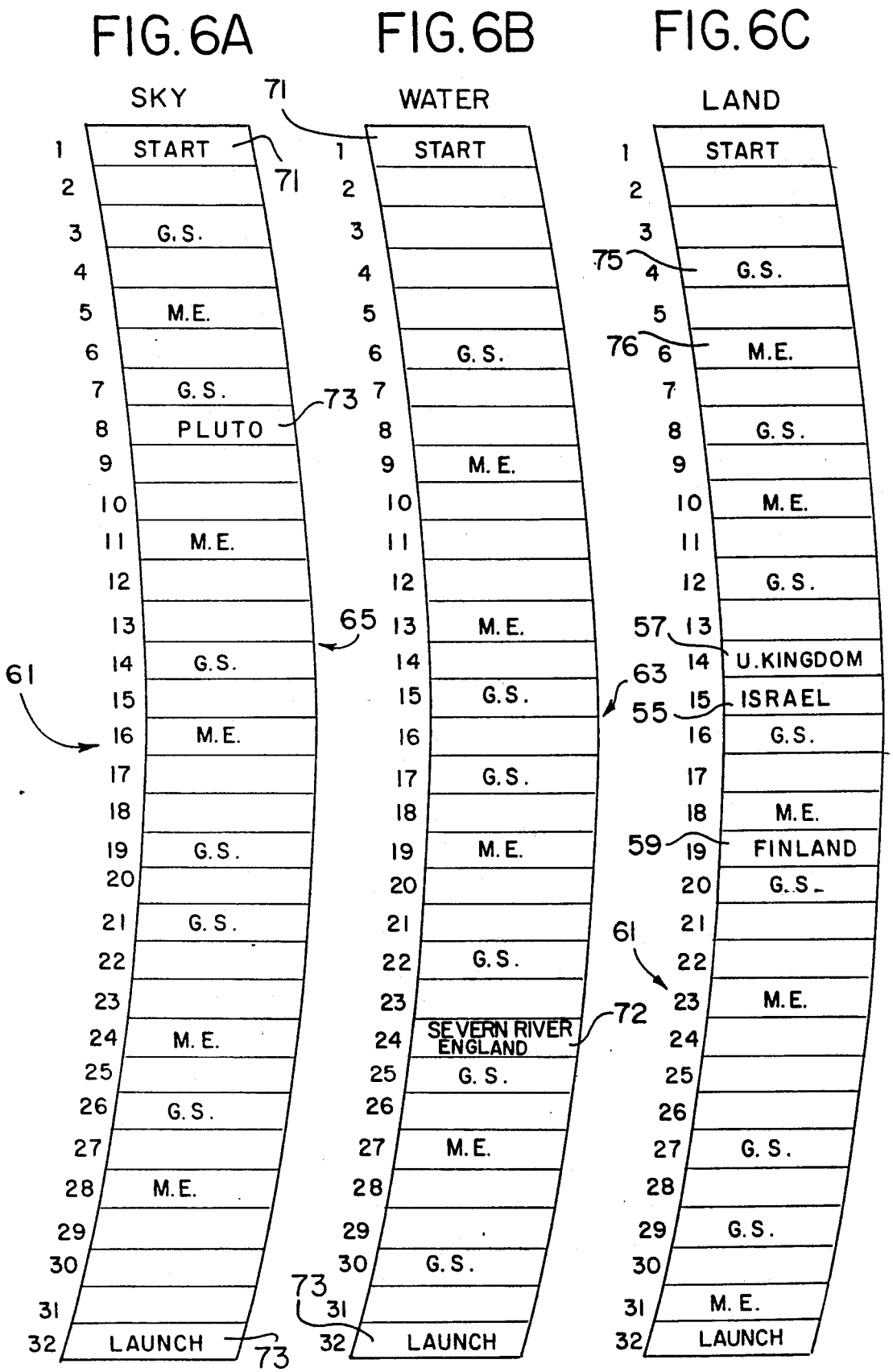
FIG. 6 shows a key illustrating the various spaces on the world board depicted in FIG. 5.
Figure 7A:
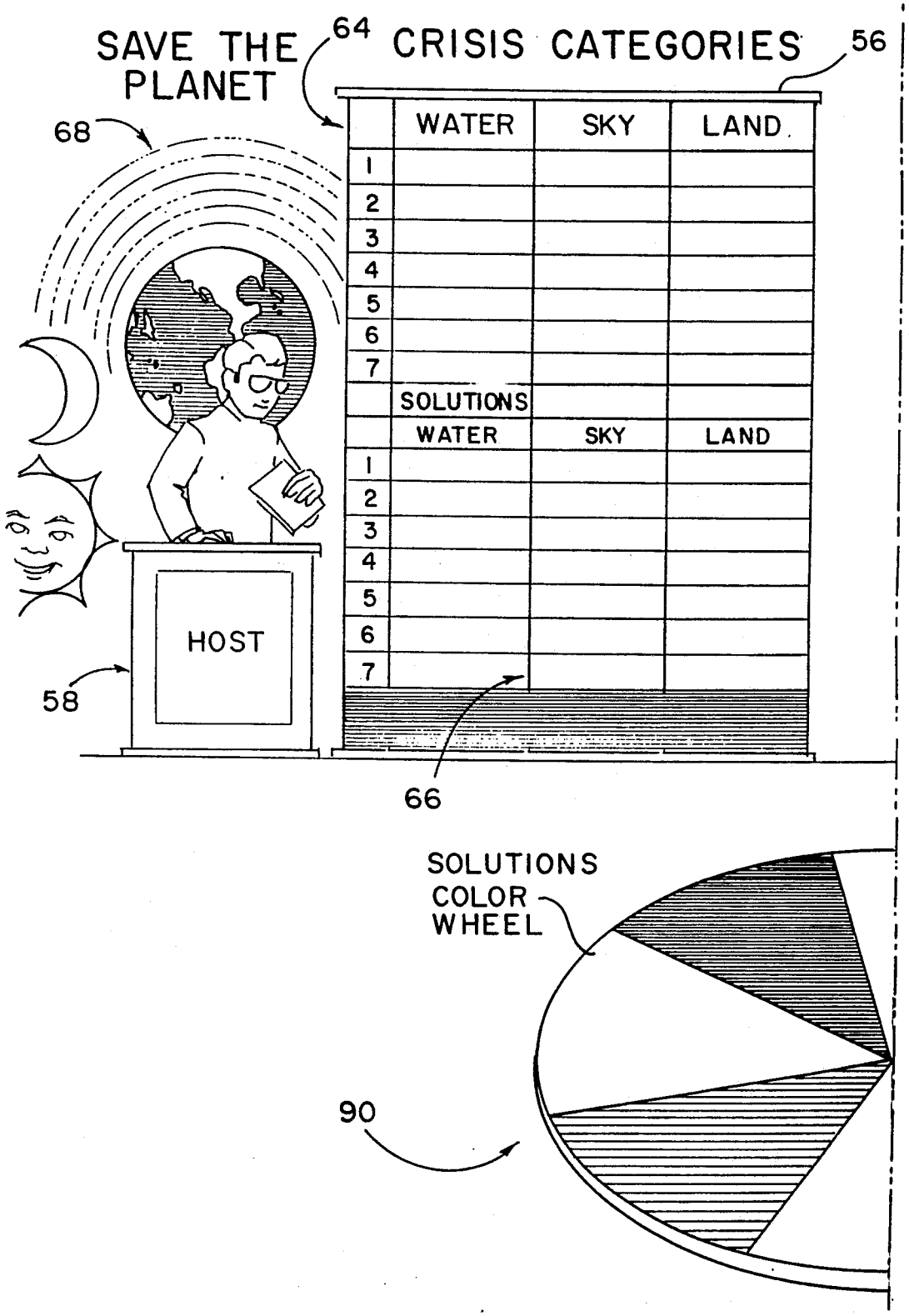
Figure 7B:
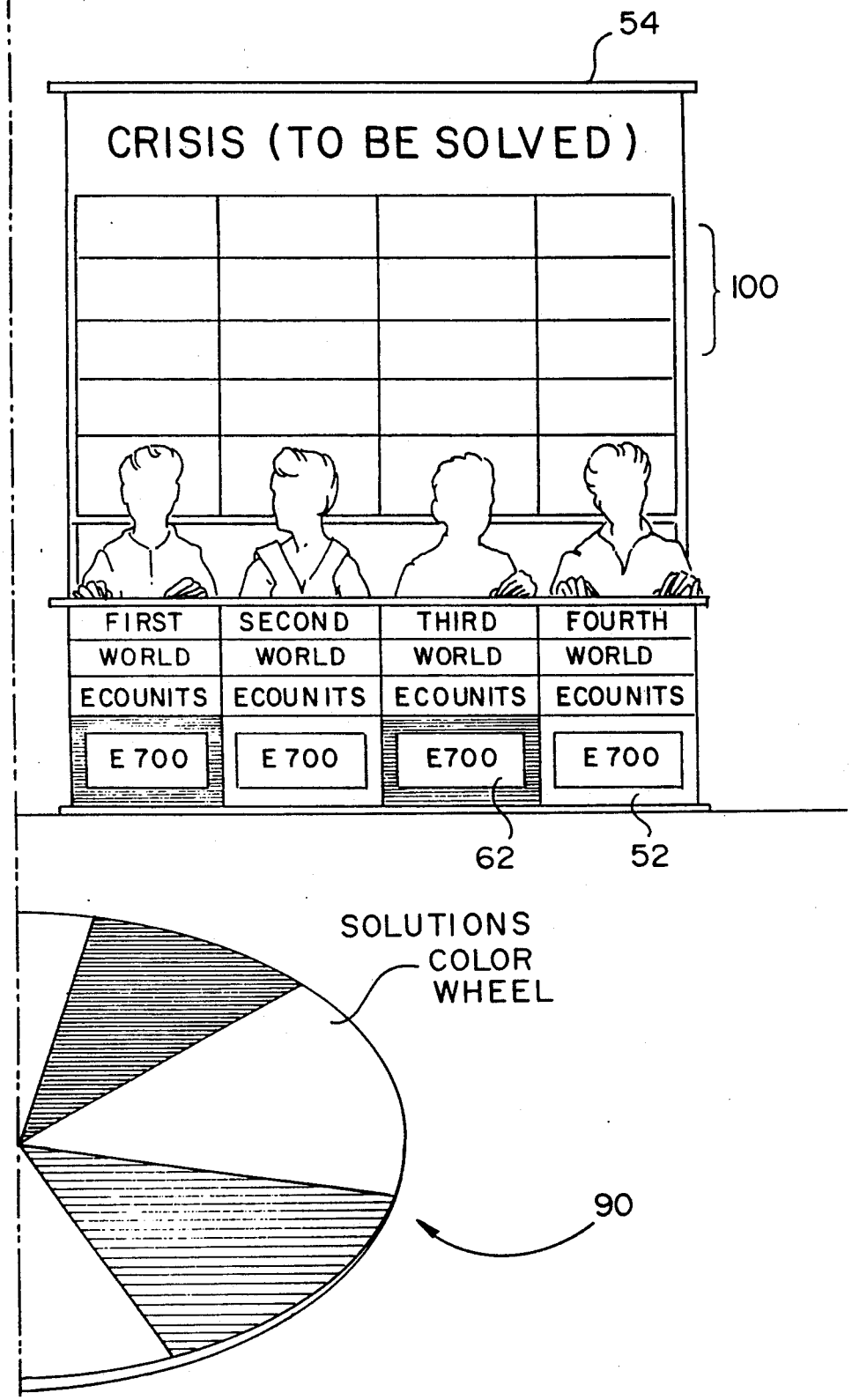

FIG. 6 shows a key which corresponds to the passageway shown in FIG. 5 for the world board 1. Each passageway includes a Start space 71, a finishing launch space 73 and a plurality of spaces in between. Each passageway consists of 32 spaces, with 20 spaces corresponding to a location consistent with the theme of the passageway, 7 spaces with the letters "G. S." thereon, the "G.S." indicia instructing a player landing on that space to draw a Grandfather Sun card and follow the instructions thereon. The remaining 5 spaces, noted by the letters "M. E." 76 on each passageway correspond to a Mother Earth space, which permits a player to select a Mother Earth card for use in solving environmental crises set forth on the Crisis Cards.

With reference back to FIG. 4 again and to FIG. 6, the space 55 depicting Israel is the land passageway space that corresponds to the space 55A shown on the land globe 9 in FIG. 4. The spaces 57 and 59, United Kingdom and Finland, respectively, are also illustrated as corresponding to spaces 57A and 59A on the land globe 9. Although not depicted, each of the 20 spaces for a geographic location on each of the passageways of each of the World Boards includes a location. Each location on each World Board, whether land, water or sky, has a corresponding location space on the appropriate land, sky or water globe.

With reference to FIG. 6 again, the water passageway 63 is shown with an exemplary location, the Severn River 72, with the sky passageway 67 showing a sky location 73, Pluto. The start spaces are the spaces each player spaces their respective tokens thereon for beginning play, with the launch spaces being used to travel to the Pathway to Paradise.

Although not depicted, the inventive board game also includes monetary units, Ecounits, which are used during transacting business, receiving gifts, or winning lotteries during playing of the game. The lottery consists of Ecolottery tickets and a lottery drum which allows a player to purchase and draw an Ecolottery ticket as rules permit. There are 160 Ecolottery tickets, 150 having no prize, 5 having a prize of 500 Ecounits, 4 having a prize of 1000 Ecounits, and 1 having a prize of 10,000 Ecounits. A World Bank may be set up to handle the distribution of the Ecounits, with either one player being designated as the Banker, or all of the players doing their own depositing and withdrawing from the World Bank.

The method of playing the inventive board game will now be described. The Central Playing Board is set up at the center of the playing surface. The counting device is arranged such that it is directly in front of a Player. The Globe Base is placed in the center of the Central Station or Playing Board. The Land Globe is inserted into the Globe Spinning Device. The Water and Sky Globes are placed into the two holding devices for future Globe Changes.

The instruction cards should be arranged on the Central Playing Board. The following are examples of Crisis Cards and corresponding Mother Earth Solution Cards, Grandmother Moon Cards and Grandfather Sun Cards, respectively.

EXAMPLE 1—LAND CRISIS

Rain Forest Destruction

Rain forests around The Planet are being destroyed at the rate of 160 acres per minute. These delicate ecosystems, which contain more than half of known plant and animal species on Mother Earth, cannot be replaced. Occupying only 6% of land, they are the lungs of the world and the homes of indigenous peoples, who possess valuable, untapped knowledge. Rain forests take literally millions of years to develop and are total systems. The soil beneath them is nutrient deficient. Only 2 or 3 years, use can be made of cleared portions.

YOU MUST SOLVE THIS CRISIS WITHIN 9 LAND TURNS

MOTHER EARTH'S SOLUTION

Rain Forest Destruction

Prevent all forms of clear-cutting in Rain Forests. Listen, carefully, to what Sting, Prince Charles and the people of the forests say. These irreplaceable forests cleanse the atmosphere and contribute air-quality and moisture regulation, at a global level. Protect indigenous populations, their traditional territories, and their ways of life. Do an inventory of species that may be sustainably harvested. Employ research scientists to discover medicinal, food and esthetic uses of previously unstudied species.

MINIMUM VALUE: E1600

EXAMPLE 2—MOTHER EARTH'S SOLUTION

Mistreated Oceans

Mistreatment of The Planet's oceans is the result of overall resource misunderstanding and mismanagement. Use satellites to detect difficulties and study trends. Strengthen international law pertaining to the seas. Identify, publicize and gain recompense from offenders. Stop overfishing, especially by ships from developed nations off the shores of developing countries. Halt dangerous dumping and control both land and atmospheric pollution. Study the long-term effects of toxins on the marine food chain. Agree and Act to Save the Seas!

MINIMUM VALUE: E3600

EXAMPLE 3—SKY CRISIS

Radioactive Hazards

Nuclear safety is non-existent. The name Chernobyl and its desolation of human life, dairies, croplands and reindeer herds, is indelibly engraved in everyone's consciousness. Three Mile Island, likewise. There's more: Reactor accidents at Windscale in the United Kingdom, France, the Netherlands, and many other places; Waste accidents in Colorado and the USSR; Mining and processing mishaps in Canada; Accidental releases of radioactivity everywhere from hospitals to municipal dumps. All create deadly atmospheric conditions.

STOP NUCLEAR PROLIFERATION WITHIN 7 SKY TURNS

MOTHER EARTH'S SOLUTION

Radioactive Hazards

Shut down the nuclear industry. That simple. It supplies only 2% of energy demand. Stop uranium mining. Requirements for medical purposes, some of which are questionable, can be met through existing stockpiles. Make mining and processing sites safe for the future. Develop large-scale renewable energy systems. As new alternatives are set-up, decommission nuclear plants. Stop sending radioactive substances into space, from where they fall into the atmosphere. Find disposal and safeguard measures—secure for millions of years!

MINIMUM VALUE: E2400

EXAMPLE 4—GUIDANCE FROM GRANDMOTHER MOON

"Appearances are deceptive"—(Aesop)

Too bad! You were given a choice between putting resources into an ugly looking, but effective, toxic chemical disposal plant, or a luxury office building for yourself and your staff. You chose the office. The donated plans didn't acount for earthquakes. While you pick through the ruins, progress is delayed.

Surrender 2 Turns—MAKE NO MOVES. JUST COUNT THIS TURN AND HOLD THIS CARD. NEXT TURN, JUST COUNT THE TURN, THEN RETURN THE CARD TO BOTTOM OF THE DRAW-PILE, FACE-UP. (YOU MAY BUY ONE ECOLOTTERY TICKET, EACH TURN.)

EXAMPLE 5—GUIDANCE FROM GRANDMOTHER MOON

"One good turn deserves another."—(Aesop)

You are being very helpful in assisting your fellow Player/Delegates to "Save The Planet". You have provided particular assistance to one of the other members of the "Circle of Solutions". As your reward:

Move Symbolic Token Now In Play—8 Spaces

TRANSACT ANY MOTHER EARTH OR GRANDFATHER SUN INSTRUCTIONS, IF YOU LAND ON ONE OF THEIR SPACES.

YOU MAY ALSO PURCHASE ONE ECOLOTTERY TICKET.

RECORD THE TURN ON APPROPRIATE COLUMN OF COUNTER.

PLACE THIS CARD AT BOTTOM OF DRAW-PILE, FACE-UP.

EXAMPLE 6—GUIDANCE FROM GRANDMOTHER MOON

"Outside show is poor sustitute for inner worth." (Aesop)

Some of the countries you represent make a great show of the "aid" and "development money" they provide to other nations. Well, in many cases, the aid is too little, wrong stuff, maldistributed, or hard to repay, so environment is destroyed and "aid" recipients go hungry. And what kind of "development" is a chemical plant that manufactures toxins that are not allowed in the country that invested the development most prosperous countries in the world devote 25% money? The most prosperous countries in the world devote 25% of their Third World investments to the chemical industry.

Move Symbolic Token Now In Play—1 SPACE

—TRANSACT ANY MOTHER EARTH OR GRANDFATHER SUN INSTRUCTIONS, IF YOU LAND ON ONE OF THEIR SPACES.

YOU MAY ALSO PURCHASE ONE ECOLOTTERY TICKET.

RECORD THE TURN ON APPROPRIATE COLUMN OF COUNTER.

THIS CARD AT BOTTOM OF DRAW-PILE, FACE-UP.

EXAMPLE 7—GRANDFATHER SUN URGES PATIENCE

"To err is human, to forgive divine." (Alexander Pope)

INSTRUCTIONS: (READ and ACT, one step at a time)

One nation has, at long last, acknowledged that air pollution from its industries is causing acid rain that destroys woodlands and lakes in a country you represent. You encourage the affected nation to gracefully and patiently accept corrective action. You receive E400 to assist with environmental restoration. Withdraw it now. Continue encouraging clean air. Change to Sky Globe. (If already in play, no change is required.) Maintain calm. DO NOT SPIN the Sky Globe. (Note: The instructions below replace those at bottom of "Grandmother Moon Card", which brought you here.) You may purchase ONE "Ecolottery Ticket". Record this turn on the Sky(S) Column of Counter. The Player to your left, clockwise, takes next turn. Until the next globe change, move only Sky Symbolic Tokens, along the Milky Way. Place the Grandmother Moon Card which started this turn at the bottom of her draw-pile, face-up. Place this card at the bottom of the Grandfather Sun draw-pile, face-up, to conclude this turn.

Set-Up of Inventive Board Game by any means agreeable among the Players and select one Player to spin the Land Globe. The honor of being "First", in this case, may be acquired by simple agreement, choosing the youngest, oldest, only. . . , or by any form of draw or coin toss.

After being selected, the first Player spins the Land Globe. When the globe stops spinning the Green Arrow on the Globe Bracket will be pointing at a location in one of the Worlds. That Player then selects the matching World Board and places it on the playing surface, directly in front of their own position, narrow end to the Central Stations. Proceeding clockwise, to the left, each Player spins the Land Globe and repeats the selection and set-up process. If the green arrow lands on a World already taken, spin again. The fourth Player automatically represents the remaining World. When all four world boards are in place, a circle is created around the Central Stations.

Now that the World Boards are allocated and in place, Crisis Cards are selected by the Players in one of two ways. The Crisis Cards and the matching Mother Earth Cards are paired and attached to one another. Each player receives Seven (7) Crisis Cards. You may choose to play only the solution cards that match the crises that are drawn. Alternatively, you may choose to leave most or all Mother Earth Cards in play.

In a first manner, only those crises and solutions which match each other are left in play.

First, shuffle the Crisis Cards and Mother Earth Cards while they are still attached and paired. The Player to the LEFT of the one that first spun the globe, shuffles the paired deck, face down, and draws the top pair. The draw continues, with the cards being passed clockwise. Draws are made from the top of the deck. Each Player takes a single pair of cards every time the deck comes around. The paired deck is passed around the board seven times.

Now, each Player has seven Crisis Cards, with the corresonding Mother Earth Solution Cards attached. Separate the Mother Earth Solution Cards from the Crisis Cards. All Players place their selected Crisis Cards adjacent the outside arc of each World Board. The Mother Earth Cards are pooled, shuffled and placed face-down in the appropriately marked Central Station. The remaining pairs of undrawn cards are located out of play, still attached.

In an alternative manner, with each player still having the required seven Crisis Cards. All 42 Mother Earth Cards are left in play, and are sometimes reshuffled. This extends the game and makes it much riskier. Remaining Crisis Cards are out of play.

Any Player may shuffle, and other Players may "cut" the deck of Grandfather Sun Cards and Grandmother Moon Cards as exemplified above. Place the resulting draw-pile of cards face-down in the space provided on the appropriately marked Central Station.

Place all Ecolottery Tickets inside the Ecolottery Draw Drum. Set the Drum in its appropriately marked Central Station.

All Players now take a Counting Device and place it in front of themselves.

Place the Ecounits in a rainbow array, inside the World Bank tray, with easy access for all.

EACH PLAYER GETS A E700 (700 ECOUNIT) FORGIVABLE LOAN AT THE BEGINNING OF PLAY.

Each Player selects three (3) Symbolic Tokens: 1 for Land, 1 for Water, 1 for Sky, in any appropriate manner.

Beginning of a protocol action in play, the first turn is taken by the Player to the left of the one who first selected the Symbolic Tokens.

Unless otherwise instructed, the play moves in a clockwise direction, to the left. That is, once a turn is finished, and the Player has marked the move on the appropriate column of the Counting Device, Action will "normally" move to the Player on the LEFT of the one whose turn has just ended.

It should be noted that after the first move, there is no definite order of play. Spins of the Globe that is in use at the time, as instructed by the Grandfather Sun Cards, quite often determine who moves which Symbolic Token and where it is to go. This may change the order, until the next spin.

THE FIRST STEP OF EACH TURN IS TO SELECT A GRANDMOTHER MOON CARD.

THE LAST STEPS OF EACH TURN ARE

COUNT THE TURN ON THE APPROPRIATE COLUMN OF THE "COUNTING DEVICE": ("L"—Land, "W"—Water, "S"—Sky) and COMPLETE PLAYING THE GRANDMOTHER MOON CARD, Either by replacing it face-up at the bottom of the draw pilel, or retaining it, if instructed to do so.

THE ARROW-SHAPED BASE OF THE SYMBOLIC TOKEN JUST PLAYED SHOULD BE POINTING IN THE DIRECTION IT IS TO MOVE ON THE NEXT TURN.

Moves by Symbolic Tokens:

The Player first draws the top Grandmother Moon Card from the face-down draw-pile.

The Player determines which Globe is in play—Land, Water, or Sky.

The Symbolic Token that matches the Globe in play will be moved along the passageway which corresponds to the Globe in play.

The number of spaces a Symbolic Token moves is directed by the Grandmother Moon Card drawn.

If the Pathway to Paradise is not yet fully paved with Mother Earth Cards, as will be described hereinafter, the Player must continue to move all Symbolic Tokens back and forth along their respective passageway, as determined by the Globe in play, at any given time. The stops along the passageway may be viewed as visits for ongoing negotiations to Save The Planet.

Thus, when a Grandmother Moon Card directs a given number of moves, the Symbolic Token in play is moved that number of spaces along its respective Course of Action. Move the Symbolic Token from "Start" to "Launch" and back gain to "Start"—back and forth, until the Pathway to Paradise is "Paved".

If the number of moves indicated is greater than the number of spaces left in a given direction, the Symbolic Token is moved to the "Start"or "Launch"space, and then reverses direction to complete the count. The arrow on the token base should remain pointed in direction of moves. For example, a Grandmother Moon Card directs " Move 7 Spaces". The Symbolic Token in play is on space #28, moving forward. It would then be moved over space numbers 29, 30, 31 and 32, which is "Launch". At this point, it has moved four counts. It now reverses direction, and moves back through 31, 30 and 29, for the remaining three counts, coming to rest on 29.

If the Pathway to Paradise is fully Paved with Mother Earth Cards on all four World Boards, movement on the game board is as follows:

Each Symbolic Token continues to move in the direction it was moving in previous plays. That is, if it was descending the Course of Action from Space #32 to Space #1, it must continue in that direction, until it reaches Space #1, "Start", and turns around.

After moving forward, from #1–#32, the Symbolic Token is "Launched" onto the first "Stepping Stone" of the Pathway to Paradise, which is #33.

For example, a Grandmother Moon Card directs, "Move 7 Spaces". The Symbolic Token in play is on Space #28, moving forward. It then moves to numbers 29, 30, 31 and 32, which is marked "Launch". The Symbolic Token now launches onto the Pathway to Paradise, and moves over the first three Stepping Stones. This completes the move of 7 spaces.

If the next Grandmother Moon Card directs "Move 5 Spaces", the Symbolic Token is placed inside "Paradise on Earth" and has achieved the Ultimate Goal.

Symbolic Tokens move back and forth along the Pathway to Paradise, until a Grandmother Moon Card provides the exact number of moves required to move into Paradise on Earth.

Once on the Pathway to Paradise, a Symbolic Token moves whenever its matching Globe is in play. If the number of moves directed by a Grandmother Moon Card exceeds the number of moves required to land in Paradise on Earth, the Symbolic Token is moved to the Seventh "Stepping Stone", reverses, and moves back along the Pathway. It continues to move back the number of spaces directed by subsequent Grandmother Moon Cards, until it reaches #33, the first "Stepping Stone" which is counted as one space. Then, it reverses again.

The Symbolic Token continues to move back and forth along the "Pathway to Paradise" until a Grandmother Moon Card provides moves over the exact number of spaces to place the Token inside "Paradise".

If the Globe in play is changed while a Symbolic Token is on the Pathway to Paradise and another Symbolic Token completes a move by landing on the same "Stepping Stone" where the first Symbolic Token is resting, then, the first Symbolic Token must return to Space #1, "Start", on its respective passageway.

The Symbolic Token that has been moved back to "Start" then proceeds back to the "Pathway to Paradise", by first moving forward along the 32 spaces of the passageway when its corresponding Globe comes back into play.

When the Symbolic Token lands on either Grandfather Sun or Mother Earth spaces, as play continues back and forth along the passageway, the appropriate Grandfather Sun Card or Mother Earth Card is drawn and is acted upon as described below.

When a turn is completed, the appropriate Symbolic Token has been moved, and all other resulting plays are finished, register the turn on the appropriate column of the Counting Device, and restore the Grandmother Moon Card that was drawn at the beginning of the turn to the bottom of the draw-pile, face-up.

Instructions for Grandmother Moon Cards are as follows:

To commence a turn, the Player draws the top card from the face-down Grandmother Moon draw-pile.

Read the "Background" of why the coming move is to be made.

Read what move is to be made.

Instructions may be given to move a certain number of spaces, ranging from "Move 1 Space" to "Move 10 Spaces".

In this case, move the Symbolic Token that corresponds with the Globe in play the designated number of spaces in the direction that the Token last moved along either its "Course of Action" or "Pathway to Paradise". If the end of the passageway or "Pathway to Paradise" is reached during the count, and it is necessary to reverse direction, then count the space at the end of the route as one space, and reverse direction for the remainder of that count. Keep arrow pointed in direction of moves.

(Please Note: There are two "Wild Cards" that enable the Player to move any Symbolic Token up to 14 spaces, in either direction, regardless of Globe in play.)

Instructions may be given to "Surrender (1–3) Turn(s)".

IN THIS CASE:

If the instruction is to surrender 1 turn, simply register the turn on the column of the "Counting Device" that corresponds with the Globe in play. Then, return the Grandmother Moon Card to the bottom of the draw-pile, face-up.

If the instruction is to surrender 2 or 3 moves, register the first turn on the column of the "Counting Device" that corresponds with the Globe in play. Then, retain the Grandmother Moon Card.

On the next turn (if 2 turns are surrendered), or the next 2 turns (if 3 turns are surrendered), do not draw a new Grandmother Moon Card. Simply register the turn(s) on the column of the "Counting Device" that corresponds with the Globe that is in play when the turn(s) occur. When the last required turn is surrendered, and the turn is registered on the correct column of the "Counting Device", return the card to the Grandmother Moon draw-pile. Place it at the bottom of the draw-pile, face-up.

When any draw-pile is entirely face-up, the cards are reshuffled and are placed face-down.

Even if turns are being surrendered, a Player may still purchase a Mother Earth Card and solve a Crisis, if the opportunity arises, as the result of another Player drawing the needed Mother Earth Card.

The Player who is surrendering a turn or turns is still entitled to purchase an Ecolottery Ticket before counting the surrendered turn.

INSTRUCTIONS FOR GRANDFATHER SUN CARDS ARE AS FOLLOWS:

When a Symbolic Token lands on one of the 7 spaces that appear on all passageways marked Grandfather Sun, the Player draws the top card from the face-down Grandfather Sun draw-pile.

Read the "Wise Observations" at the top of the card. Then, read the "Instructions for Action".

The "Instructions for Action" may include an "Ecounit Gift" or purchasing an Ecolottery ticket.

IN THE CASE OF AN ECOUNIT GIFT: Determine who receives it and when the Gift is to be received. It may be made for the draw, or it may be made after a Globe Spin; If made as the result of the draw, the Player who made the draw receives the Gift.

Either the player who drew the card, or the player who moves as a result of the globe spin, may receive the Gift. In three cases, if the one who draws and the one who moves are the same, that player receives double the number of ecounits.

The "Instructions for Action" may include a Globe Change.

IN THIS CASE: The Player who makes the draw places the appropriate new Globe in the "Globe Bracket". From this point, until the next "Globe Change", only those Symbolic Tokens that correspond with the new Globe in play are moved.

IF THE DESIGNATED GLOBE IS ALREADY IN PLAY, NO CHANGE IS MADE.

The "Instructions for Action" may include a "Globe Spin". It will also state which of the "Rainbow Arrows" to read at the end of the "Globe Spin".

IN THIS CASE: The Player whose turn it is spins the

Globe in play—whether the original Globe or a new one that has been installed, as the result of a "Globe Change" instruction; the designated "Rainbow Arrow" will be pointing at a specific place or natural feature, at the end of the spin. The Player who has the corresponding place or natural feature on a World Board moves the appropriate Symbolic Token to that space. If the ecounit gift is to be collected after the globe spin, it is now collected by the designated player. The instructions will provide directions that replace those of the Grandmother Moon Card which started the turn, including which player records the turn, and which player takes the next turn. The Grandmother Moon Card and the Grandfather Sun Card are then returned to their respective draw/piles face-up.

INSTRUCTIONS FOR MOTHER EARTH CARDS:

A "Sustainable Solution" For Every "Crisis Card" are as follows:

When a Symbolic Token lands on one of the 5 spaces that appear on all passageways marked "Mother Earth", the Player draws the top card from the face-down "Mother Earth" draw-pile. If the Mother Earth Card has a "Sustainable Solution" that applies to a "Crisis Card" held by the Player who makes the draw, the Player who makes the draw now has a FREE SOLUTION. That Player places the Mother Earth Card face-down on any uncovered Stepping Stone of their own Pathway to Paradise. After the Mother Earth Card has been placed on a Stepping Stone, the Player takes the matching Crisis Card and clips it to the World Board, face-down, with NO SOLUTION FEE being paid. If the Mother Earth Card has a "sustainable Solution" that applies to a "Crisis Card" held by any other player, the Player who makes the draw must offer to sell the Mother Earth Card to the Player with the matching Crisis Card, for no less than the minimum price, which is clearly stated on the Mother Earth Card; OR, the Player selling the Mother Earth Card is entitled to negotiate with the holder of the matching Crisis Card for any amount above the stated "Minimum Price". It is wise to have a sound reason for raising the price of a Mother Earth Card. If the intended buyer refuses to purchase the Mother Earth Card at the requested price, or is unable to complete the transaction, the Seller's avarice may be a key factor in over all "extinction". If this happens, everyone loses, and the game is over.

If a Player buys a Mother Earth Card, the following occurs:

First, the Buyer pays the agreed-upon price to the Player who drew the card;

Second, the Buyer places the Mother Earth Card face down on any uncovered Stepping Stone of their own Pathway to Paradise.

Third, after the Mother Earth Card has been placed on a Stepping Stone, the Player takes the matching Crisis Card and clips it to the World Board, face down.

Fourth, the Buyer now collects a "Solution Fee" of E700 from the "World Bank";

Fifth, the Player who drew the Mother Earth Card, and sold it to the Buyer, complete play for that turn, by counting the move on the appropriate column of their own "Counting Device",and restoring the Grandmother Moon Card to the bottom of the draw-pile, face up. Play moves clockwise, to the left, as usual;

If a Player DOES NOT BUY a Mother Earth Card, then, the Player who drew the card replaces it in the Mother Earth draw-pile and reshuffles the Mother Earth deck, then ends the turn.

If all Mother Earth Cards are being played, there are Mother Earth Cards in play that do not apply to "Crisis Cards" in play.

If a Mother Earth Card is drawn that DOES NOT match a "Crisis Card" held by anyone in the passageways, the Player who drew the Mother Earth Card replaces it in the draw-pile, and reshuffles the Mother Earth Deck, then ends the turn. As a Player of the game, it is the PRIME OBJECTIVE of each Player to solve all Crises or problems in play. In addition to being individually responsible for seven "Crisis Cards", each Player is also responsible for collaborating with all other Players to "Save The Planet".

Each Crisis or problem must be solved WITHIN THE NUMBER OF MOVES designated on the lower right corner of the "Crisis Card".

Each "Crisis Card" is color-coded and states whether it is a "Land", "Water" or "Sky" Crisis. This designation determines which of the three columns on the "Counting Device" is read, in order to determine how many turns have been taken in the related "Realm".

For example, if a "Sky" Crisis must be solved within 15 turns: Each time the Player completes a turn when the Sky Globe is in play, the Sky column of the Counting Device is advanced 15 one digit. When #14 is reached, in that column, the Player then has one chance to avoid "Extinction", which means "GAME OVER", FOR EVERYONE. Therefore, the matching Mother Earth Card with the "Sustainable Solution" to the particular "Crisis" must be either drawn or purchased, BEFORE it is necessary to register #15 on the "Sky" Counter This rule applies in "Normal" play, regardless of how many "Crisis Cards" a Player has drawn in any "realm". When a Player draws a Mother Earth Card that matches one of their seven "Crisis Cards", that Player has a "FREE SOLUTION" and follows the steps as described above for a free solution.

When a Player buys a Mother Earth Card from another Player, in order to solve a "Crisis":

Follow the steps as described above for buying a Mother Earth Card.

VITAL INFORMATION ABOUT NEGOTIATIONS:

If a Player draws a Mother Earth card that provides a "Sustainable Solution" for a "Crisis Card" held by another Player, the one who drew the card is entitled to sell the Mother Earth Card to the Player who requires it.

Although the Mother Earth Card has the Minimum Price clearly marked, the Player who drew the card may wish to negotiate a Higher Price. THIS MAY INVOLVE NEGOTIATIONS WITH ALL MEMBERS OF THE GAME, AS FOLLOWS:

If the Player requiring the Mother Earth Card wishes to make the purchase, yet does not have sufficient Ecounits to complete the transaction, that Player may turn to other Players and the "World Bank" for assistance. If any or all of the other Players agree to assist with the purchase, alone or together with others, the following procedure is implemented:

First, a final price is negotiated, involving the "Seller", "Buyer" and any other Player who wishes to become involved in the transaction.

When the bargain is struck, the Players who are assisting with the purchase of the Mother Earth Card must pool one-half of the shortfall between the amount the Buyer has and the agreed upon price.

The "World Bank" will automatically provide the other one-half of the shortfall. For example, there is agreement that a particular Player is to purchase a Mother Earth Card for E2,000.

The "Buyer" only has E200. This leaves a SHORTFALL of E1800.

Other Players agree to contribute a non-repayable grant, totalling E900, to assist the "Buyer" in obtaining the Mother Earth Card.

The "World Bank" automatically provides a forgiveable loan of E900, to the "Buyer".

The "Seller" is paid the E2,000, and the Mother Earth Card is purchased, with play proceeding in accordance as described above.

As soon as the crisis is solved, the "World Bank" Loan is forgiven.

IN SUMMARY, if the Buyer is able to raise HALF the SHORTFALL, the "World Bank" will provide the other half.

"Extinction" occurs when any Player fails to solve any "Crisis" within the number of turns designated on any "Crisis Card". When this happens, the game is over.

When all Players have solved all their crises and paved all Stepping Stones with Mother Earth Cards, the Grandmother Moon Cards determine the number of moves that the Players may make along the Pathway to Paradise. The first Player to get all three Symbolic Tokens in to Paradise on Earth is declared the winner.

In an alternative embodiment, the globe spinning device of the inventive game may be substituted with a rotating disc assembly. An exemplary rotating disc assembly is depicted in FIGS. 9 and 10 and is generally designated by the reference numeral 100. The disc assembly includes a base 101 which is adapted to receive a stepped disc 103. The stepped disc 103 is mounted on a pin 102 protruding from the base 101 to permit rotation of the disc 103.

The rotating disc assembly also includes a stepped pointer device 105 which is adapted to be attached to the base 101 at the reference numeral 109 and also attached to the center of the disc 103 at a reference numer 107. The pointer device 105 is designed to be merely inserted into the base and disc such that the pointer device may be readily removed if a different disc is to be used in the rotating disc assembly. The stepped disc 103 is divided into a plurality of concentric playing spaces 104. It should be understood that the spaces 104 correspond with the spaces 50 as described above for the globe assembly depicted in FIG. 4, with the same geographic location depicted in the spaces on the disc as well as the same number of spaces and color coded pointers. The pointer device 105 has seven pointer elements 110 thereon which facilitate selection of a space on the disc 103 when the disc is rotated by a player. The disc 103 is spun during playing of the game in the same manner as the globes are spun as described above.

It should be understood that three discs exists in the alternative embodiment; one for land, one for sky and one for water. Furthermore, during playing of the game, whenever an instruction is given to select a globe or spin a globe, a corresponding instruction, during playing of the game in the alternative embodiment would include selecting a disc or spinning the disc in the disc space.

In a second embodiment, the inventive game, as described hereinabove, for a board game, may also be adapted for a television game show. With reference to FIGS. *7a* and *7b*, a portion of the television game show layout is illustrated. As can be seen from these figures, in place of the individual World Boards used by Players during the board game, the Players have Stations 52 to participate in the game. Each Station 52 represents one of the four World Boards as described in the board game and includes display means 62 to indicate the number of Ecounits each Player has. Situated behind the Players' Station 52 is a display board 54 that illustrates the crises each Player has selected for solving during playing of the game. Areas where examples of different crises may be shown are indicated by the reference numeral 100.

Adjacent the display board 54 is a second display board 56. This display board is divided into two categories, crises or problems 64 and solutions 66. The crises or problems are categorized by land, water and sky, and the numbers 1–7 which correspond to the colors red, orange, yellow, green, blue, indigo and violet, with the solutions 66 categorized in a similar manner. As will be described hereinafter, Players use the display board 56 to select different environmental crises or problems and to display solutions obtained through chance means.

Adjacent the display board 56 is a host station 58 wherein a host may stand or sit and direct the playing of the game.

FIG. 8 shows additional parts of the television game show layout including a spinning wheel 90 which is designed to be manually spun by the Players. The spinning wheel 90 is adjacent a pointer display 91, the pointer display 91 being adjacent to Player station 52. In this layout, a Player may manually spin the wheel with the Player's pointer on the pointer display 91 indicating which segment of the spinning wheel the Player has selected. The spinning wheel is spun on every turn of the game by an appropriate Player. Also depicted in FIG. 8 is an electronic spinning globe 80, which is divided into three areas of the game, land 81, water 82, and sky 83. During play, when a Player is instructed to have a globe spin, a Player may push a button which spins the globe and randomly selects a geographical location in one of the three designated areas. It should be understood that this globe spinning is analogous to the globe spinning device of the board game, wherein a Player spins a particular globe and selects a particular geographic location to move on a given World Board. It should be further understood that the means for operating the electronic spinning globe including means to illustrate or illuminate a particular geographic location in one of the designated areas is well known in the art and, as such, is not intended to be an aspect of the inventive game.

With reference, again, to the spinning wheel 90, eleven segments are illustrated which correspond to the categories as described above in the inventive board game. Specifically, the spinning wheel includes a Grandfather Sun segment, a Grandmother Moon segment, an Ecolottery segment, a World Bank segment, and a Mother Earth Solution segment, each Mother Earth Solution segment including therein a given color, either red, orange, yellow, green, blue, indigo or violet. As will be described hereinafter, a Player spins the wheel and follows the instructions pertaining to the segment that corresponds to that particular Player's pointer.

Although not depicted, the game show may also include display means for illustrating the instructions set forth for the Grandfather Sun and Grandmother Moon segments similar to the instructions as set forth hereinabove for the inventive board game. In addition, a drum or other chance means may be used for drawing the Ecolottery tickets.

The manner in which the inventive game is adapted for play using the television game layout will now be described. The goal of the television game show is similar to that of the inventive board game in that all Players are to act together to solve real-world environmental issues. The host acts as the Chairman and organizes proceedings and ensures that the game is properly played.

Similar to the inventive board game, Ecounits are used as the monetary values for conducting business in the television game show. These Ecounits serve as the exchange by which environmental crises may be acted upon with the World Bank designating distribution of the Ecounits and permitting forgiveable loans by giving one-half of a shortfall to any Player needing such an amount to solve a crisis or problem. It should be noted that if one or all other Players decide to provide the other one-half of the shortfall and Ecounits, the Player or Players have only 30 seconds in which to decide. If a decision is not reached in that time, the crisis or problem will not be able to be solved and the game will be over.

With regard to the spinning wheel, the spinning wheel is spun at the beginning of every turn by the Player whose turn it is. Once a particular segment on the spinning wheel is selected, that Player is to follow the instructions pertaining to that segment. For example, if the spinning wheel lands on a Grandmother Moon or a Grandfather Sun Card, the instructions for these cards may be displayed on a display means wherein a wise message may be given or gifts/penalties of Ecounits may be imposed. It should be noted that the instructions for either the Grandmother Moon or the Grandfather Sun segments are similar to that as described hereinabove for the board game. In a similar fashion, the crises or problems and corresponding solutions for the television game show all may correspond to those set forth for the board game.

If the spinning wheel lands on one of the Mother Earth Solution color-coded segments, a corresponding Solution is lit up on the display board 66. Therein, a particular solution for a particular crisis or problem is displayed with a minimum value of Ecounits associated therewith. A Player may raise the price of the selected Mother Earth Solution providing that the reasoning for increasing the price is environmentally sound. The solution, at the increased price, may then be sold to a Player who requires it for their particular crisis. Although not depicted in the spinning wheel 90, an additional segment, a Mother Earth Wild segment, may be included, wherein a Player, getting this segment, may choose a color at random for the solution associated therewith.

If the spinning wheel lands on a World Bank slot, the World Bank pays out 700 Ecounits to that particular Player. If the spinning wheel lands on an Ecolottery slot, a Player must pay 100 Ecounits to participate in the Ecolottery. The Ecolottery is conducted in a similar manner as that described for the inventive game board hereinabove.

With respect to the electronic spinning globe 80, if a Grandfather Sun segment is obtained by a Player, a globe review may be requested, similar to the globe reviews in the inventive board game, and a Player may push a button or the like which causes the globe to spin and randomly select a location in either the land, water, or sky areas. Once this geographical location is selected, this counts as a turn with respect to a corresponding crisis or problem that that particular Player has. For example, if a Player has a land crisis to solve in 5 turns, and the globe review results in the globe randomly selecting a geographic location in the land area, this counts as one turn used for that particular player. The result is that that Player now has only 4 turns in which to solve that particular land environmental crisis.

At the beginning of play, each Player begins with 700 Ecounits. Each Player then draws color cards which have on the back thereof one of the four designated worlds. In this manner, the Players randomly select the particular world they are to represent. The Players then take their places at their stations and choose more colors on the display board 54. The choice of a particular color lights up a corresponding crisis or problem randomly in either the water, sky, or land categories. This selected crisis or problem is then displayed on the display board 54 above that particular Player. After the selection of all of the colors by all of the Players, all of the crises or problems that are to be solved during playing of the game are displayed on the display board 54 above a respective Player.

All Players must stay in the game and must work to solve their crisis or problem in the times allotted before the game is over. Each crisis or problem has a different number of turns allotted thereto in which the crisis or problem must be solved. It should be noted that a Player may draw upon one emergency measure to avoid the crisis or problem not being solved and the game ending. The emergency measure may add an additional turn to a selected crisis or problem.

The object of the game is for a Player to solve all of that Player's crises or problems. Once this is done, the game is over and the environmental crises or problems that have been facing the Planet Earth have been solved. It should be noted that, although a spinning wheel as a chance device has been shown in the television game show embodiment along with an electronic spinning globe, other known chance devices as well as known display means may be utilized in the present invention. It should also be understood by those skilled in the art that the devices and means described for the television game show are all understood to be well known in the art and as such are not intended to be an aspect of the invention.

Although the inventive game is depicted globally, the scope of the geographic locations may be altered. For example, rather than a theme of saving the planet, the theme may be "Save New York", with the geographic locations on the boards and globes pertaining to the City of New York. The geographical theme may vary from expansive areas such as countries to small towns or cities.

Additionally, the game may be adapted for children's play by associating a cartoon character with the various instruction means and geographical locations. For example, the wise sayings on the Grandfather Sun cards may be quoted by Porky Pig or Elmer Fudd. Additionally, the geographical locations or spaces on the game board and globes may portray a cartoon character in association with a given place.

As such, an invention has been disclosed in terms of preferred embodiments thereof which fulfill each and every one of the objects of the invention as set forth hereinabove and provides a new and improved game having an environmental theme of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved board game having an environmental problem solving theme for a plurality of players comprising:

(a) a plurality of tokens for movement during play, each player having three tokens during play;

(b) a plurality of pie-shaped game boards, each said pie-shaped game board including:

(i) a plurality of passageways thereon, at least two of said passageways including spaces thereon for travel by said tokens during playing of the game, and a further one of said passageways for travel by said tokens when a given environmental problem has been solved; and (ii) a final play portion adjacent one end of said further of said passageways;

(c) a first set of instruction means containing a plurality of problems, means corresponding to each problem for indicating a given number of turns to be taken by said players and a second set of instruction means containing corresponding solutions to said environmental problem information;

(d) a third set of instruction means for directing movement of a said player on a said game board, (e) a plurality of counting devices for recording turns completed by said players during playing of the game, (f) whereby, at the beginning of play, players select a predetermined number of said instruction means containing environmental problems, players take turns moving said tokens along said at least two passageways and, during movement thereon, each player attempts to seek and obtain said corresponding solutions to each of their said selected problems within said given number of turns to be taken as indicated on their said selected problems, and whereby matching of an instruction means containing a corresponding solution to a said environmental problem permits travel along a said further one of said passageways and completing travel along a said further one of said passageway resulting in reaching said game board final play portion and winning of said game.

2. The invention of claim 1, further including a fourth set of instruction means for directing playing of the game, one of said fourth set of instruction means awarded when a Player lands on a predetermined space on one of said at least two passageways.

3. The invention of claim 2, further including a globe' holding and spinning device and a plurality of globes, each globe being adapted to be supported and spun when placed in said globe holding and spinning device, selection of a said globe for spinning during play being determined by one of said fourth set of instruction means.

4. The invention of claim 3, wherein each said globe has spaces thereon, each said space including indicia thereon showing a geographic location.

5. The invention of claim 2 further including a rotating disc holding and spinning device and a plurality of discs, each disc being adapted to be supported and spun when placed in said rotating disc holding and spinning device, selection of said disc for spinning during play being determined by one of said fourth set of instruction means.

6. The invention of claim 5, wherein each said disc has spaces thereon, each said space including indicia thereon showing a geographic location.

7. The invention of claim 1, further including monetary units for transacting business during playing of the said game.

8. The invention of claim 1, wherein each said token includes a base portion having an arrow thereon for indicating the direction of travel of a said token along one of said passageways.

9. The invention of claim 1, further including lottery tickets for use during playing of said game, said lottery tickets being obtained during playing of said game.

10. The invention of claim 1, wherein each one of said at least two passageways includes spaces thereon having indicia directing a said Player to select one of said second set of instruction means and one of a fourth set of instruction means, said fourth set of instruction means providing instructions for play for a said player.

11. The invention of claim 1, wherein a portion of said spaces on each one of said at least two passageways includes indicia thereon showing a geographic location.

12. A television game show apparatus for playing a game between a plurality of players, wherein environmental problems are solved comprising:

(a) a plurality of player stations, each player station representing a geographical area and including a display means for indicating a monetary value a said player has achieved during playing of said game;

(b) a first display board divided into three categories, each category being divided into a plurality of differently colored display areas, each display area corresponding to a different problem, said display board being adapted to display an environmental problem according to a color selected by a said player;

(c) a second display board, said second display board being adapted to display an environmental problem selected by a said player;

(d) a chance device, said chance device comprising a spinning wheel having a plurality of categories thereon, said categories further comprising:

(i) a plurality of first instruction means representing a solution to a said environmental problem;

(ii) second instruction means for directing playing of the game;

(iii) third instruction means for receiving monetary units; and (iv) further instruction means for purchasing lottery tickets, (v) whereby players take turns spinning said wheel and receiving a said category, a said player following instructions on said category, (e) a third display means for displaying a said solution to one of said environmental problems, a said solution being determined by spinning of said wheel by a said player, (f) whereby players select said environmental problems and attempt to win the game by obtaining a corresponding solution to said environmental problems by spinning of said wheel, the first player to solve said selected environmental problems in a given amount of turns being declared the winner of the game.

13. The invention of claim 12, further including a spinning globe, said spinning globe being divided into a plurality of geographic locations, whereby a said player, by spinning said wheel and receiving a said second instruction means, may spin said glove and record a turn of said game, said game being over if a said player does not solve a said environmental problem before a predetermined number of turns.

14. The invention of claim 12, further including a host station wherein a host may direct play of said game.

15. The invention of claim 14, further including a fifth display means for displaying instructions for said second instruction means.

* * * * *